United States Patent [19]

Derby, Jr.

[11] 4,146,949

[45] Apr. 3, 1979

[54] METHOD FOR MAKING A MAGNETRON ANODE

[75] Inventor: Ralph F. Derby, Jr., Wilmington, Mass.

[73] Assignee: Raytheon Company, Lexington, Mass.

[21] Appl. No.: 868,961

[22] Filed: Jan. 12, 1978

[51] Int. Cl.[2] ..... H01P 11/00

[52] U.S. Cl. ..... 29/25.14; 29/463

[58] Field of Search ..... 29/25.14, 463; 315/39.51, 39.75

[56] References Cited

U.S. PATENT DOCUMENTS

| | | | |
|---|---|---|---|
| 2,948,061 | 8/1960 | Carstens | 29/463 |
| 3,608,167 | 9/1971 | Safran et al. | 29/25.14 |
| 3,678,575 | 7/1972 | Akeyama et al. | 315/39.51 |
| 3,792,306 | 2/1974 | Smith et al. | 315/39.57 |
| 4,041,350 | 8/1977 | Shitara et al. | 315/39.75 |

*Primary Examiner*—Richard B. Lazarus
*Assistant Examiner*—John McQuare
*Attorney, Agent, or Firm*—David M. Warren; Joseph D. Pannone; Milton D. Bartlett

[57] ABSTRACT

A magnetron anode is constructed of performed blanks which are bent in two portions of which one portion is a vane and a second portion is a segment of a cylindrical surface of the anode. Alternate blanks are provided with an alternate arrangement of supports for strapping rings of the magnetron anode. The assembly of cylindrical segments is enclosed within a sleeve to which the segments are brazed to provide an air tight wall of the magnetron anode.

4 Claims, 8 Drawing Figures

METHOD FOR MAKING A MAGNETRON ANODE

BACKGROUND OF THE INVENTION

A form of magnetron such as that disclosed in the U.S. Pat. No. 3,792,306 which issued in the name of Smith et al. on Feb. 12, 1974 has an anode in the form of a circular cylindrical tube with radial vanes extending inwardly therefrom. A magnetron with a similarly formed anode finds extensive use today in microwave ovens. The procedure of the prior art for the manufacture of magnetrons is unduly expensive, particularly in the foregoing situation wherein large numbers of magnetrons are manufactured. The cost is also a problem when such internally vaned tubing is utilized in other situations such as a fluid conductor in a heat exchanger.

SUMMARY OF THE INVENTION

The foregoing problem is overcome and other advantages are provided by the construction of a magnetron anode by a procedure, in accordance with the invention, wherein a set of blanks having generally T-shaped blanks which are formed by stamping. A first group of these blanks is formed with strapping ring supports of a first configuration and a second group of the blanks is formed with strapping ring supports of a second configuration. The center leg of each blank is bent to provide a vane while the remaining portion of the blank is utilized for forming a segment of a cylindrical wall of the anode. The blanks of the first and second groups are positioned alternately in an assembly of the blanks to provide for electrical contact by strapping rings at alternate ones of the vanes. The assembly of cylindrical segments with the vanes extending radially inward therefrom is inserted into an outer sleeve which is brazed to the cylindrical segments for forming an airtight wall of the anode.

BRIEF DESCRIPTION OF THE DRAWINGS

The aforementioned aspects and other features of the invention are explained in the following description taken in connection with the accompanying drawings wherein.

DESCRIPTION OF THE PREFERRED EMBODIMENT

Figure 1:
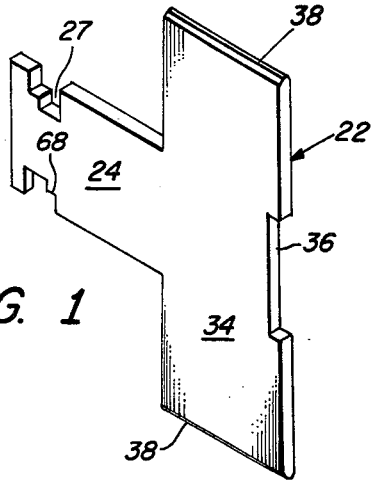
FIG. 1 shows a T-shaped blank to be utilized, in accordance with the invention, in forming a magnetron anode.
Figure 2:
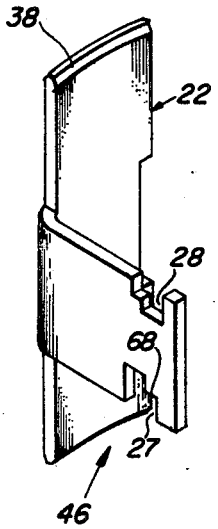
FIG. 2 shows the blank of FIG. 1 bent to provide a strapping ring support of a first configuration.
Figure 3:
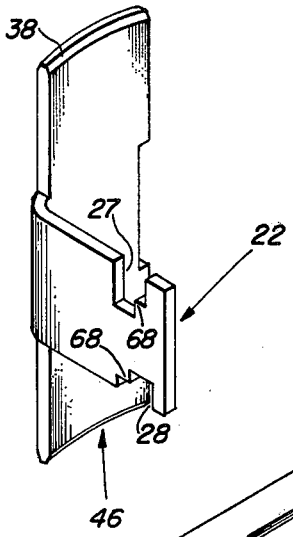
FIG. 3 shows the blank of FIG. 1 bent to provide the strapping ring support of a second configuration.
Figure 4:
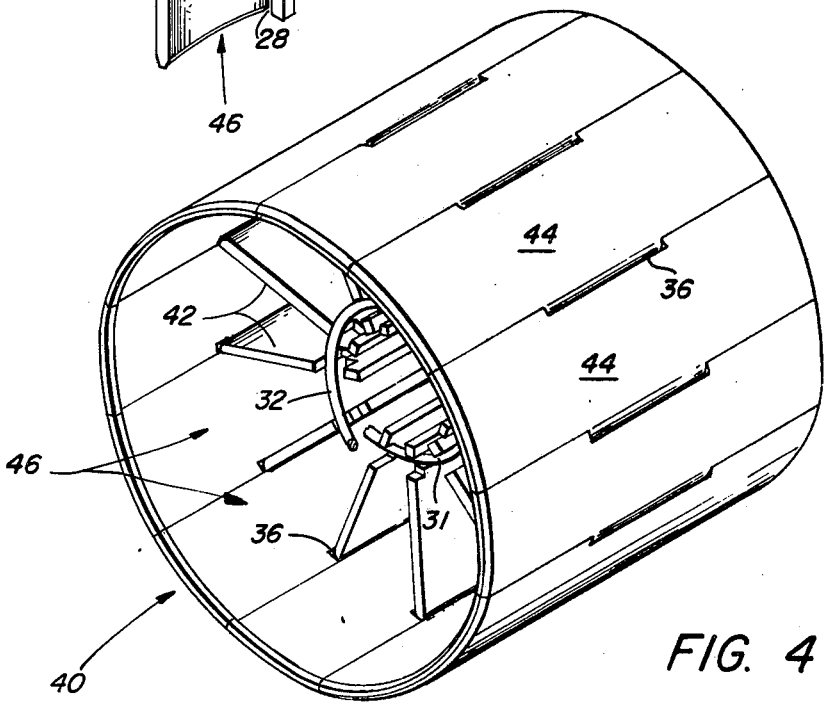
FIG. 4 shows an assembly of the bent blanks with the blanks of the first and second groups being alternated in position to provide for alternating contact of the strapping rings with the vanes, portions of two such strapping rings being shown to illustrate the support thereof.
Figure 5:
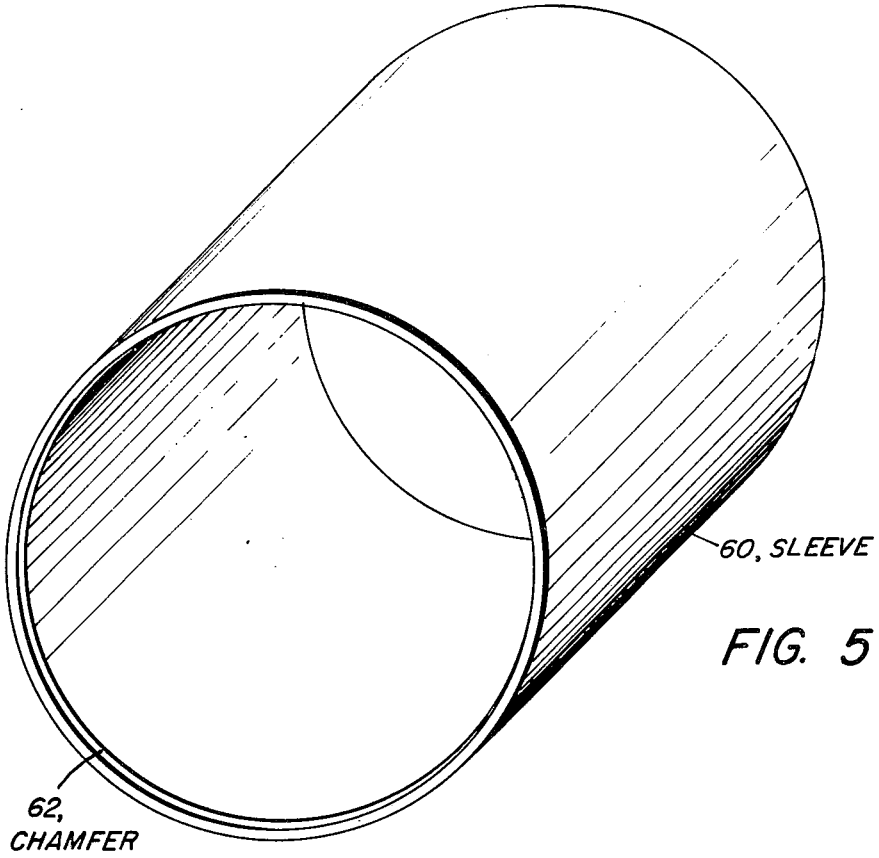
FIG. 5 shows a tubular sleeve for enclosing the assembly of FIG. 4.

Referring now to FIGS. 1–6, a magnetron anode 20 is formed of blanks 22 having a generally T-shaped form comprising a leg 24 having first and second notches 27–28 for supporting inner and outer strapping rings 31–32. An arm portion 34 of the blank 22 has a central notch 36 for accommodating the leg 24 of a neighboring blank in the assembly of the anode 20. The arm portion 34 has chamfers 38 which are provided by a coining operation in the forming of a blank 22 to facilitate assembly of the anode as will be described hereinafter.

An assembly 40 is formed of a set of blanks 22 wherein the leg 24 of each blank 22 is bent to provide a vane 42 of the anode 20 while the arm portion 34 of the blank 22 is rounded to form a cylindrical segment 44 of the anode 20. With respect to the bending of the legs 24, the set of blanks 22 is divided into two groups with the legs 24 of one group being bent in the opposite sense from the bending of the legs 24 of the other group. The bent blanks 22 are then arranged as section 46 of the assembly 40 with the bend of one blank 22 being nested in the central notch 36 of a neighboring blank. The assembly 40 has an outer cylindrical surface formed of the cylindrical segments 44 of each section 46 with the vanes 42 being directed radially inward. As viewed from one end of the cylindrical axis of the assembly 40, the first and second notches 27–28 of alternate sections 46 of the assembly 40 are seen to alternate in their respective positions for engaging alternate ones of the rings 31–32.

Figure 7:
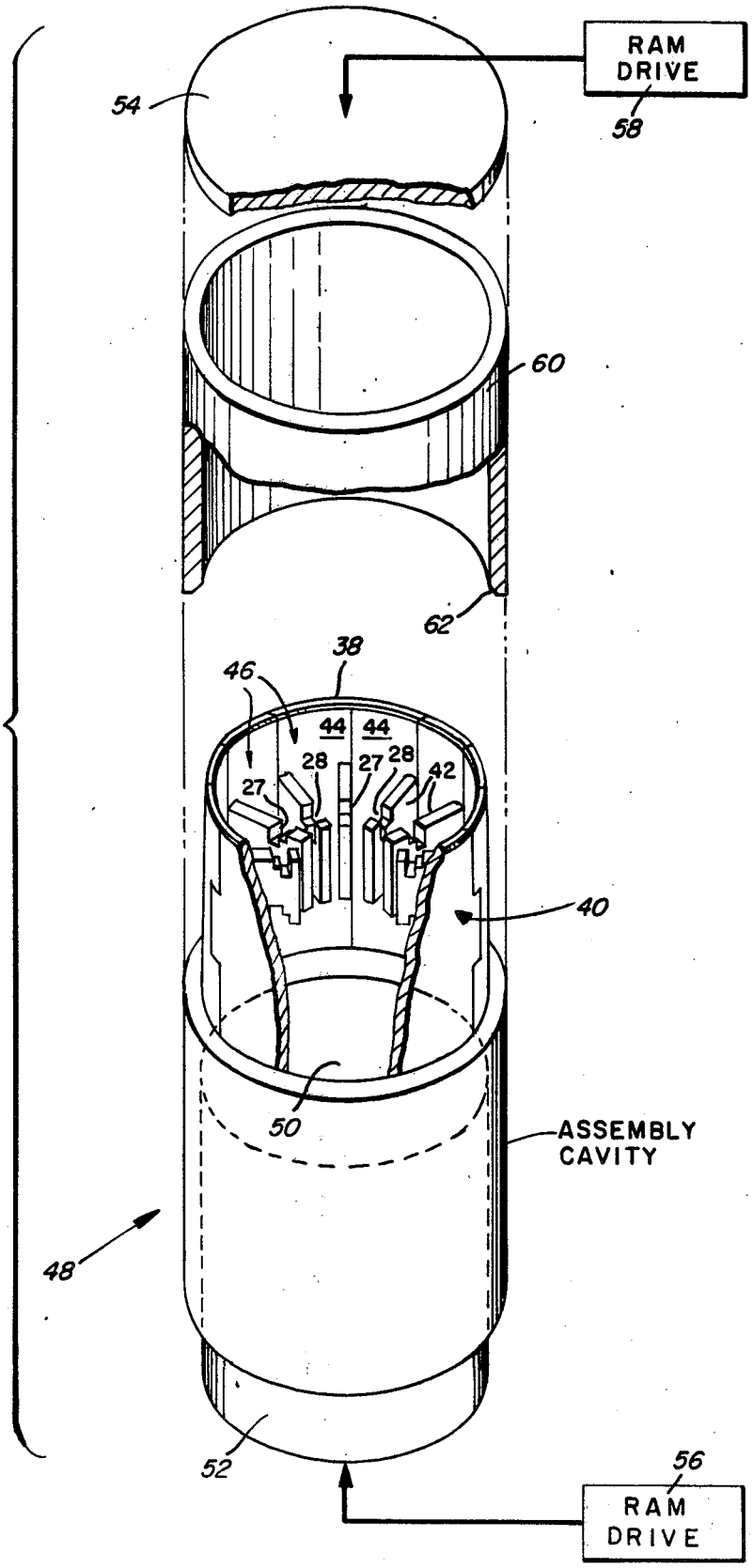
FIG. 7 shows a jig utilized in supporting the cylindrical segments in position and including rams for forcing the assembly of cylindrical segments within the sleeve.

With reference also to FIG. 7, a jig 48 comprises a cavity 50 of which the bottom portion is formed of a ram 52 with an opposed ram 54 being positioned above the cavity 50 along the axis of the ram 52. Drive units 56 and 58 urge the rams 52 and 54 toward each other. The sections 46 are arranged along the interior wall of the cavity 50 with the sections 46 being alternated between the two groups of bent blanks to provide the aforementioned alternation in the positions of the first and second notches 27–28. The blanks 22, as well as a sleeve 60 which is utilized for enclosing the sections 46, are fabricated of a machinable electrically conducting material such as copper with a silver plating being applied to the arm portion 34 of each of the blanks 22. The sleeve 60 is held down against the upper rim of the cavity 50 by the ram 54 whereupon the ram 52 urges the assembly 40 upward into the sleeve 60. A chamfer 62 along the inner edge of the sleeve 60 cooperates with the chamfers 38 to facilitate entry of the assembly 40 into the interior of the sleeve 60. The internal diameter of the sleeve 60 is selected to provide intimate contact between the outer cylindrical surfaces of the segments 44 with the inner surface of the sleeve 60. After the insertion of the assembly 40 into the sleeve 60, the sleeve 60, with the assembly 40 therein, is placed in a brazing furnace (not shown in the figures) for brazing the outer surfaces of the cylindrical segments 44 to the inner surface of the sleeve 60 to provide an airtight wall of the anode 20 for maintaining a vacuum within the magnetron. The strapping rings 31 and 32 are supported respectively in the first notches 27 and the second notches 28 of alternate ones of the sections 46, the rings 31 and 32 being secured to steps 68 in the respective notches 27–28 by brazing.

Figure 6:
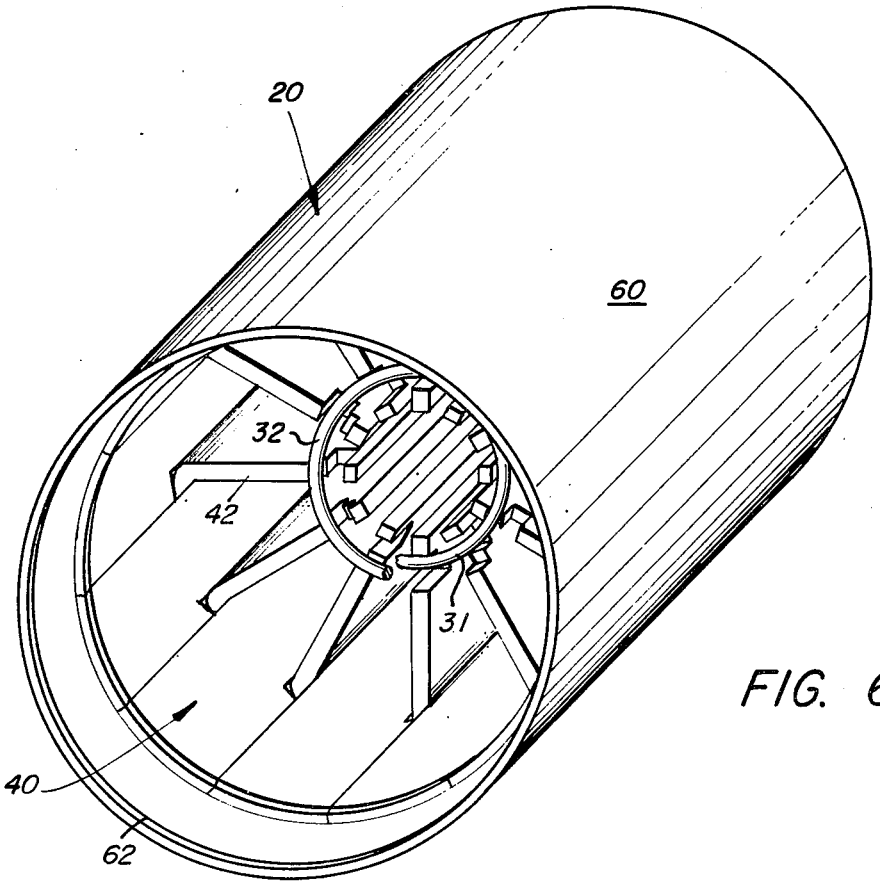
FIG. 6 shows a completed assembly of the magnetron anode with portions of the strapping rings being shown.
Figure 8:
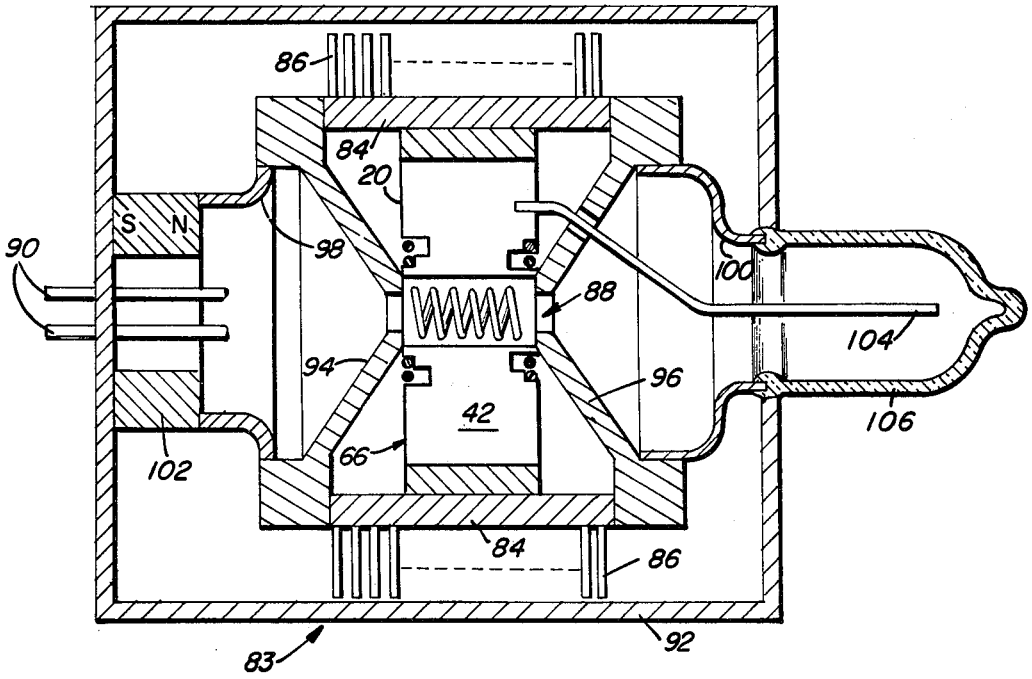
FIG. 8 shows a magnetron incorporating an anode constructed in accordance with the invention

Referring now to FIG. 8, there is seen a simplified portrayal of a magnetron 83, similar to that shown in FIG. 1 in the aforementioned Smith patent, and comprising the anode 20 of FIG. 6. The anode 20 is secured within an outer copper ring 84 having cooling fins 86 attached thereto whereby heat is withdrawn from the anode 66. A cathode and heater assembly 88 is positioned along the axis of the anode 20 and is secured by wires (not shown) to leads 90 seen passing through a case 92 which encloses the magnetron 83. Magnetic pole pieces 94 and 96 are secured to the ends of the copper ring 84 and direct a magnetic field along the axis of the anode 20. Collars 98 and 100 secure the pole pieces 94 and 96 respectively to a ring shaped magnet 102 and to the forward end of the case 92, the back end of the magnet 102 being secured to the back end of the case 92. The case 92 and the collars 98 and 100 are constructed of a ferrous material such as iron for completing the magnetic circuit between the magnet 102 and the pole pieces 94 and 96. An antenna 104, affixed to a vane 42 of FIG. 6, conducts electromagnetic radiation from the region within the anode 20 to a region within a dielectric dome 106 from which it is coupled to a utilization device such as a waveguide for a microwave oven.

By way of example, in the case of a magnetron being utilized in a microwave oven producing radiation at 2450 megahertz, the diameter of the assembly 40 is approximately 1½ inches, the thickness of a blank 22 is approximately sixty-thousandths of an inch, a similar thickness being utilized in the wall of the sleeve. An axial length of approximately one inch may be utilized.

It is understood that the above-described embodiment of the invention is illustrative only and that modifications thereof may occur to those skilled in the art. Accordingly, it is desired that this invention is not to be limited to the embodiment disclosed herein but is to be limited only as defined by the appended claims.

What is claimed is:

1. A method of fabricating a magnetron anode comprising the steps of:

forming a T-shaped blanks each having first and second supporting structures thereon, said blanks each having a leg portion and an arm portion, said first and second supporting structures being positioned on opposite sides of said leg portion;

bending the leg portions of a first group of said blanks to provide a set of vanes having said first support structure on a top side thereof;

bending the leg portions of the blanks of a second group of said blanks to provide a set of vanes having said second support structure on a top side thereof;

arranging said vanes to point radially inwardly with the arm portions of said blanks forming an outer cylindrical surface of an assembly of said blanks; and securing said assembly to the interior of a sleeve.

2. A method according to claim 1 further comprising the step of rounding said arm portions of respective ones of said blanks to form said outer cylindrical surface of said assembly.

3. A method according to claim 2 further comprising the step of coining said blanks to provide a chamfer of each of said arm portions of said blanks to facilitate entry of said assembly into said sleeve.

4. A method according to claim 3 further comprising the step of applying a brazing agent to said blanks, said securing being accomplished by brazing said assembly to the interior surface of said sleeve.

* * * * *